US006125499A

United States Patent [19]

Downey

[11] Patent Number: 6,125,499

[45] Date of Patent: Oct. 3, 2000

[54] HIGH FLOW STEAM CARPET CLEANER

[76] Inventor: Mike Downey, 1041 S. Clark Blvd., Clarksville, Ind. 47129

[21] Appl. No.: 09/275,563

[22] Filed: Mar. 24, 1999

Related U.S. Application Data

[63] Continuation-in-part of application No. 08/761,745, Dec. 5, 1996, Pat. No. 5,907,879.

[51] Int. Cl.[7] ..... A47L 7/00

[52] U.S. Cl. ..... 15/321; 15/339; 15/353

[58] Field of Search ..... 8/158; 15/320, 15/321, 339, 353

[56] References Cited

U.S. PATENT DOCUMENTS

| | | | |
|---|---|---|---|
| 3,883,301 | 5/1975 | Emrick et al. | 8/158 |
| 3,909,197 | 9/1975 | Cremers | 8/158 |
| 3,939,527 | 2/1976 | Jones | 15/320 X |
| 3,940,826 | 3/1976 | Phillips et al. | 15/320 |
| 3,974,541 | 8/1976 | Silvis et al. | 15/320 |
| 4,080,104 | 3/1978 | Brown | 15/353 X |
| 4,114,229 | 9/1978 | Jones et al. | 15/320 |
| 4,307,484 | 12/1981 | Williams | 15/321 |
| 4,378,611 | 4/1983 | Ninehouser | 15/353 |
| 4,458,377 | 7/1984 | Frohbieter | 15/321 X |
| 4,723,337 | 2/1988 | Ellison et al. | 15/321 X |

*Primary Examiner*—Chris K. Moore
*Attorney, Agent, or Firm*—Middleton & Reutlinger; John F. Salazar

[57] ABSTRACT

A lightweight portable steam carpet cleaning machine comprised of two main structures, a handle assembly and the recovery tank. Connected to the machine are two hoses, the supply hose which supplies clear water to the machine and the discharge hose which takes dirty water away depositing it in a sanitary disposal. A capacity spray jet is used to apply a high volume of clear water to the carpet. A recovery tank which is less than a cubic foot in volume is used to transport the vacuum from the vacuum motor to the water pick-up. During the cleaning process, a channel is used to direct extracted water to the bottom of the recovery tank. A float switch is used to automatically activate or deactivate the discharge pump during the cleaning process.

22 Claims, 5 Drawing Sheets

HIGH FLOW STEAM CARPET CLEANER

This application is a continuation-in-part of U.S. Ser. No. 08/761,745 filed Dec. 5, 1996, now U.S. Pat. No. 5,907,879, issued Jun. 1, 1999.

BACKGROUND OF THE INVENTION

1. Field of the Invention

The present invention relates to high flow steam carpet cleaning machines.

2. Discussion of the Prior Art

The machine of the present invention relates to high flow portable hot water extractors, also called portable steam carpet cleaners. These machines have almost always been self-contained. By self-contained it is meant it has a holding tank for its cleaning water and a large recovery tank for the dirty water. These machines work by pulling water from the holding tank with a high pressure pump, spraying it on the carpet and recovering it with a vacuum source forming a water pick-up area.

Traditionally, the main problem with steam carpet cleaning machines has been their over wetting of carpets. This over wetting is due to the inability of these machines to generate enough vacuum at the carpet. This inability has led to restricting the amount of water used in the cleaning process. This restriction in water flow has limited the cleaning ability of these machines.

The water recovery systems within these machines produces much less vacuum or suction at the carpet than the machine described herein, even though they often use the same type of vacuum motor. This is caused by three reasons: the much longer distance between their vacuum motor and water pick-up; the comparatively large volume of air contained in their recovery tanks; the comparatively large area the vacuum acts upon on the inside of their recovery tanks (i.e. the volume of the recovery tank).

All steam carpet cleaning machines have recovery tanks. These are the tanks which hold the recovered water sprayed onto the carpet. Other than the machine of the present application, there are only two other known types of portable steam carpet cleaning machines. Both of these types have similar recovery tanks:

1) Self-Contained Pull Behind Machines which have recovery tanks in the 7 to 10 gallon range;
2) Box and Wand Machines which have recovery tanks in the 10 to 18 gallon range.

The main difference with these two types of machines is that the box and wand type of machine has a vacuum hose running from the recovery tank to the cleaning wand. The self-contained pull behind type of machine has the cleaning wand connected directly to the recovery tank. None of these machine, however utilize a high flow of water however due to the inability to recover the water by the vacuum How these recovery tanks work is as follows. A vacuum motor or motors which generates both air flow and water lift is mounted on the outside of the recovery tank. A vacuum hole in the recovery tank allows the vacuum generated by the vacuum motor to enter the tank. When the wand or water pick-up channel part of the machine makes contact with the carpet, it partially closes the system. The vacuum motor immediately starts removing air from the recovery tank. As air is removed from the recovery tank a vacuum or suction is exerted on both the inside area of the vacuum tank and the carpet that is under the water pick-up channel. This vacuum increases as more and more air is removed from the recovery tank.

Since all vacuum motors are limited in the amount of air they can remove per minute, it stands to reason that the smaller the volume of air in the recovery tank the faster the vacuum will act at the carpet under the water pick-up channel. Also since all vacuum motors are limited in the power they can generate, it stands to reason that the fewer square inches this power has to act upon the more response the vacuum system will have. Therefore, the lower volume of air and surface area within the recovery tank the faster the vacuum response.

In a large recovery tank much of the power generated by the vacuum motor is wasted by acting on the large inside volume of the recovery tank. To get as much vacuum to the carpet as possible, it is vitally important to reduce the volume of the recovery tank. By doing this you usually reduce the distance between the vacuum motor and the water pick-up.

Further, this does not resolve the main problem faced with prior art machines, namely low water flow rates to the carpet. Typical water flow rates for steam machines are less than one gallon per minute. This low flow rate reduces the ability of the machine to remove significant amounts of soil from the carpet. Thus, it is desirable to have a machine which introduces a high flow of water to the carpet while providing the ability to remove to sprayed water and to prevent the overwetting problems noted above.

SUMMARY OF THE INVENTION

The recovery tank of the present invention has 3 to 7 times less volume than machines. The inside area of the recovery tank is anywhere from 2.5 to 5 times smaller than any other machines. The recovery tank is less than one cubic foot in volume. It is mounted less than 14 inches from the water pick-up channel. In operation, the high flow carpet cleaner of the present invention provides more powerful vacuum much quicker at the carpet than other prior art machines. This is true even when using identical vacuum motors. The machine of the present invention also has a much higher percentage of water recovery whereby percentage of water recovery equals the total water recovered divided by the total water used.

The importance of reducing both the volume and the inside surface area of the recovery tank has been previously mentioned. One dimension that is difficult to reduce is the height of the recovery tank. The reason for this is there has to be sufficient distance between the highest recovered water level on the inside of the recovery tank and the place where the vacuum enters the recovery tank. If the vacuum enters the recovery tank too close to the highest recovered water level, it will draw the recovered water into the vacuum motor. The vacuum generated by the vacuum motor enters the recovery tank about 9.5 inches from the bottom of the recovery tank. The highest recovered water level on the bottom of the tank is about 3 inches. This gives the machine a height differential of about 6.5 inches. This height differential is important in protecting the vacuum motor and is an extremely important concept concerning the functionality of the machine.

Because of the extremely high percentage of water recovery the machine generates, it is able to increase the amount of water used in the cleaning process. A water flow rate of one gallon per minute is high for most portable steam cleaning machines. The present machine has a flow rate of more than 1.5 gallons of water per minute and preferrably between 3 to 4 gallons of water per minute. This high flow rate is 3 to 4 times greater than other prior art machines. Even with this increased water flow, the machine has consistently had much better drying times of the carpet than other machines using less than one-third the water flow. The size of the spray jet directly impacts the flow rate of the machine of the present invention. It uses a 27 capacity (0.173 orifice diameter) spray jet. Most machines use 6 capacity (0.062" orifice diameter) or less.

The increase in water flow allows the machine described herein to flush more foreign matter (dirt, soil, bacteria, etc.) from carpets much faster than other machines. The machine of the present invention provides a controlled flood style of clean carpet by introducing high volume of water in the carpet. It generates a flushing effect in carpets, using its powerful vacuum system to dislodge more foreign matter from carpets, much faster than previously possible.

The machine of the present application has improved many aspects of the portable steam carpet cleaning process including:

1) It uses a much higher clear water flow (3 to 4 times higher than other machines) which rinses fibers more thoroughly than previously possible;
2) Using the same or similar vacuum motor it generates such a high vacuum at the carpet that even with more than 3 times the water flow, it leaves carpets much dryer than other machines. It solves the over wetting problem associated with portable steam carpet cleaning machines;
3) Operators can clean faster and more thoroughly than previously possible. This reduces labor cost and increases quality;
4) The operating weight is less than half of most other machines. It is so small it can fit into the trunk of most cars. Most other machines need a truck for transportation;
5) Because it is lightweight and of the straight upright position of the operators back when cleaning with the present machine, the chronic back problems commonly associated with carpet cleaners is greatly reduced; and
6) It will increase indoor air quality in carpet environment after use due to its ability to clean carpet using higher flow rate of water.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
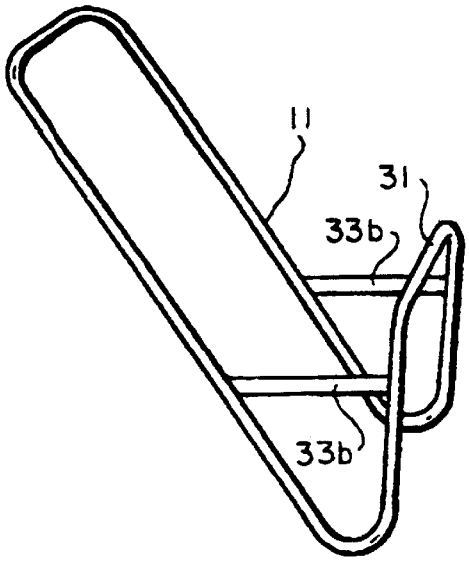
FIG. 1 is a perspective view of the handle for the carpet steam cleaner of the present invention.
Figure 2:
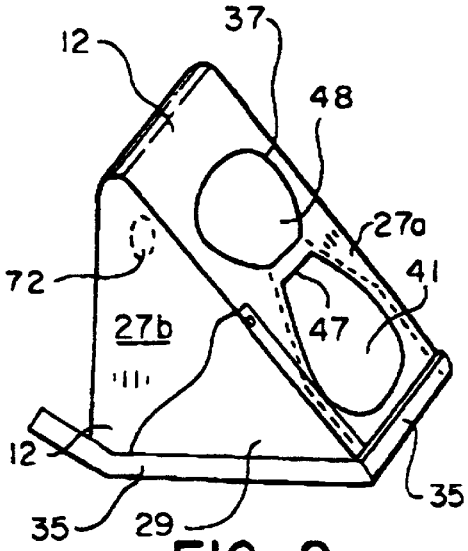
FIG. 2 is a perspective view of the recovery tank with vacuum hole and window channel and water channel opening for the steam cleaner of the present invention.

The high flow steam carpet handle has two main structures, the handle 11 and recovery tank 12, shown in FIGS. 1 and 2. Other structures to be described herein are mounted on either the handle or the recovery tank.

Figure 3:
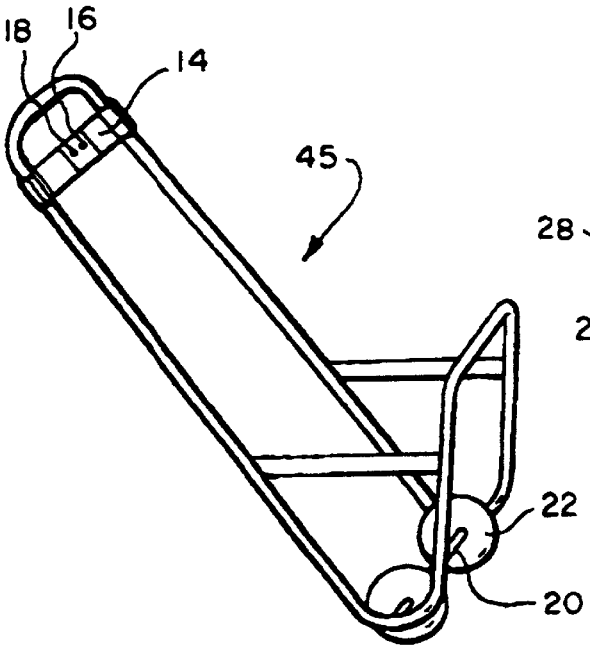
FIG. 3 is a perspective view of the handle assembly of the carpet steam cleaner of the present invention.
Figure 4:
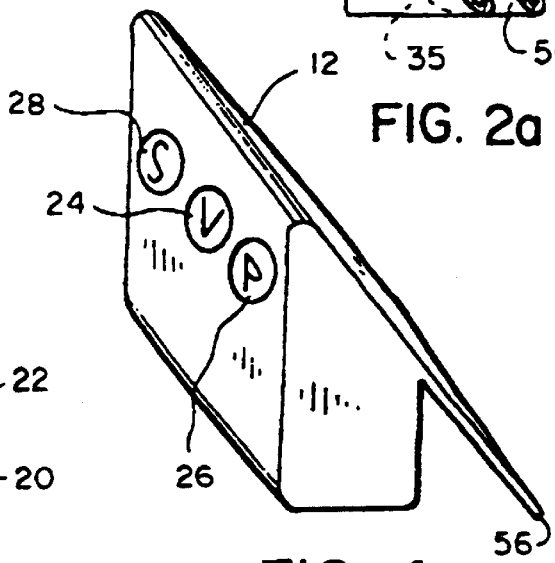
FIG. 4 shows a perspective view of the back of the recovery tank of the resent invention.

The handle 11 is made of 1 inch O.D. 18 gauge steel. Attached to the handle are two essential assemblies. The control panel assembly 14 of FIG. 3 is made of ⅛" vacuum formed plastic. This control panel assembly 14 contains two switches 16 and 18. The vacuum switch 16 is used to turn the vacuum motor 24 of FIG. 4 on and off. The other switch on the control panel assembly 14 is the spray jet switch 18. This switch is used to either open or close the solenoid valve 28. The other essential assembly connected to the handle is the axle assembly 20. This assembly 20 attaches to the bottom of the handle as shown in FIG. 3. The wheels 22 go on the axle assembly 20 at opposite distal ends of the axle 20. When both the control panel assembly 20 and the axle assembly are attached to the handle, it is called the handle assembly 45. Additionally, carrying handle 31 and side support bars 33*a* and 33*b* are provided. The side support bars provide lateral support of the machine 10 when pulling or pushing during cleaning.

Figure 9:
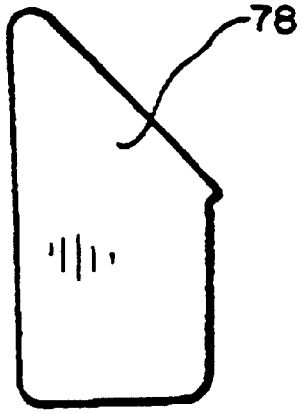
FIG. 9 shows side view of one end cap for the recovery tank of the present invention.
Figure 11:
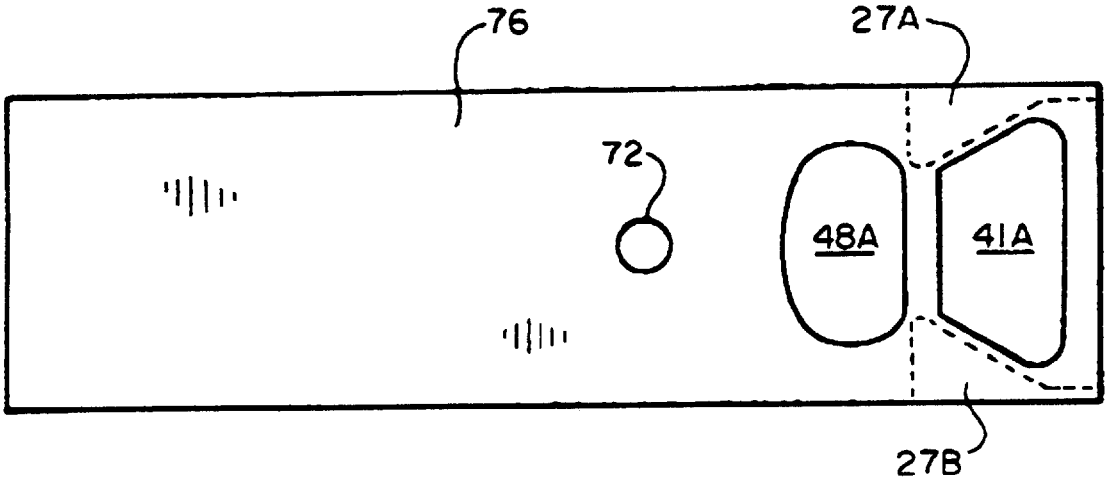
FIG. 11 shows a top view of the main body of the recovery tank on the flat before formation.
Figure 12:
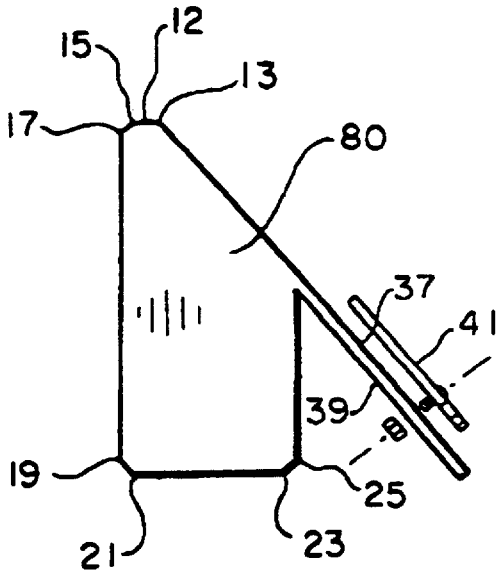
FIG. 12 shows side view of the main body of the recovery tank of the present invention after bending.

The second main structure on the machine 10 is the recovery tank 12. Of FIG. 2. This recovery tank 12 is made of 3 pieces of 0.063 thickness 5052 H-32 aluminum. The main body of the recovery tank 12 is formed out of the metal flat 76 shown in FIG. 11. The flat sheet 76 which forms the recovery tank 12 is then to molded to form the main body of the recovery tank 80 as is shown in FIG. 12. The remaining two pieces of the recovery tank 12 are the end caps 78 shown in FIG. 9. These two end pieces 78 are identical and are welded to either side of the main body 76 of the recovery tank 12. As can be seen in FIG. 12, seven of the eight bends, 13, 15, 17, 19, 23 and 25, in the main body of the recovery tank 12 are 45 degrees bends. This is done to strengthen the inside of the recovery tank 12. This construction reduces the flexion of the tank when subjected to strong vacuum, maintaining its yield strength.

Attached to each side of tank 12 are wing braces 29 (the one on the opposite side is not shown due to the perspective). The wing brace supports the downwardly extending water pickup channel 56 formed between the inner 39 and outer 37 faces of the flat 76 once it is formed to shape. Wing braces provide further support to prevent bending or other wear to the water pick-up channel 56. Additionally, formed on the outer face 37 are the window channel aperture 48*a* and water channel aperture 41*a*. Separating the apertures is member 47.

Figure 2A:
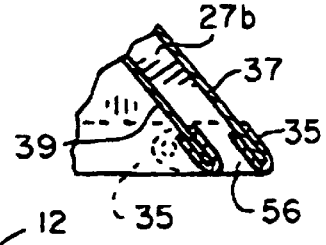
FIG. 2*a* is a side view of the water pick-up channel.
Figure 10:
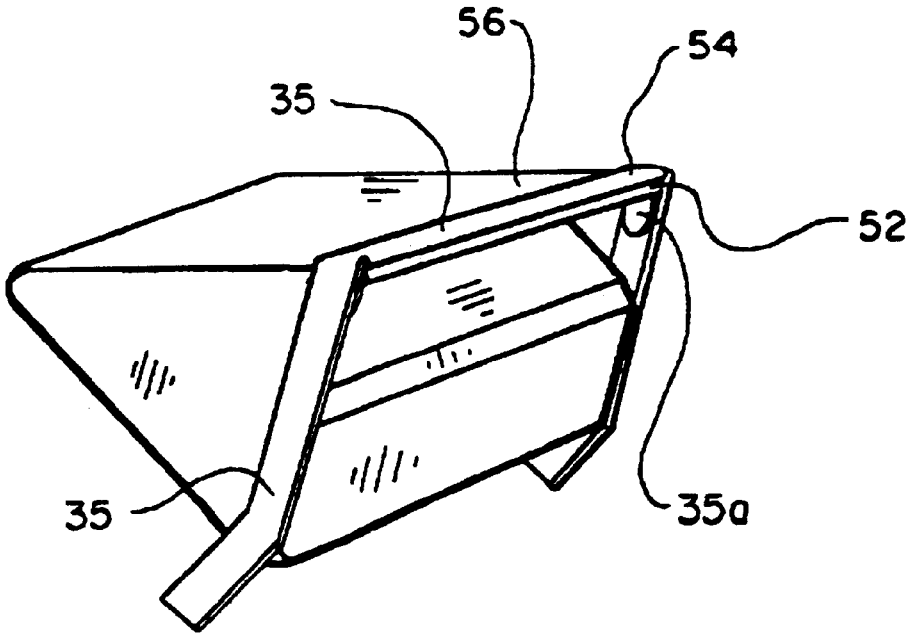
FIG. 10 shows perspective view of recovery tank of the present invention showing the water pick-up between the inner and outer lips.
Figure 14:
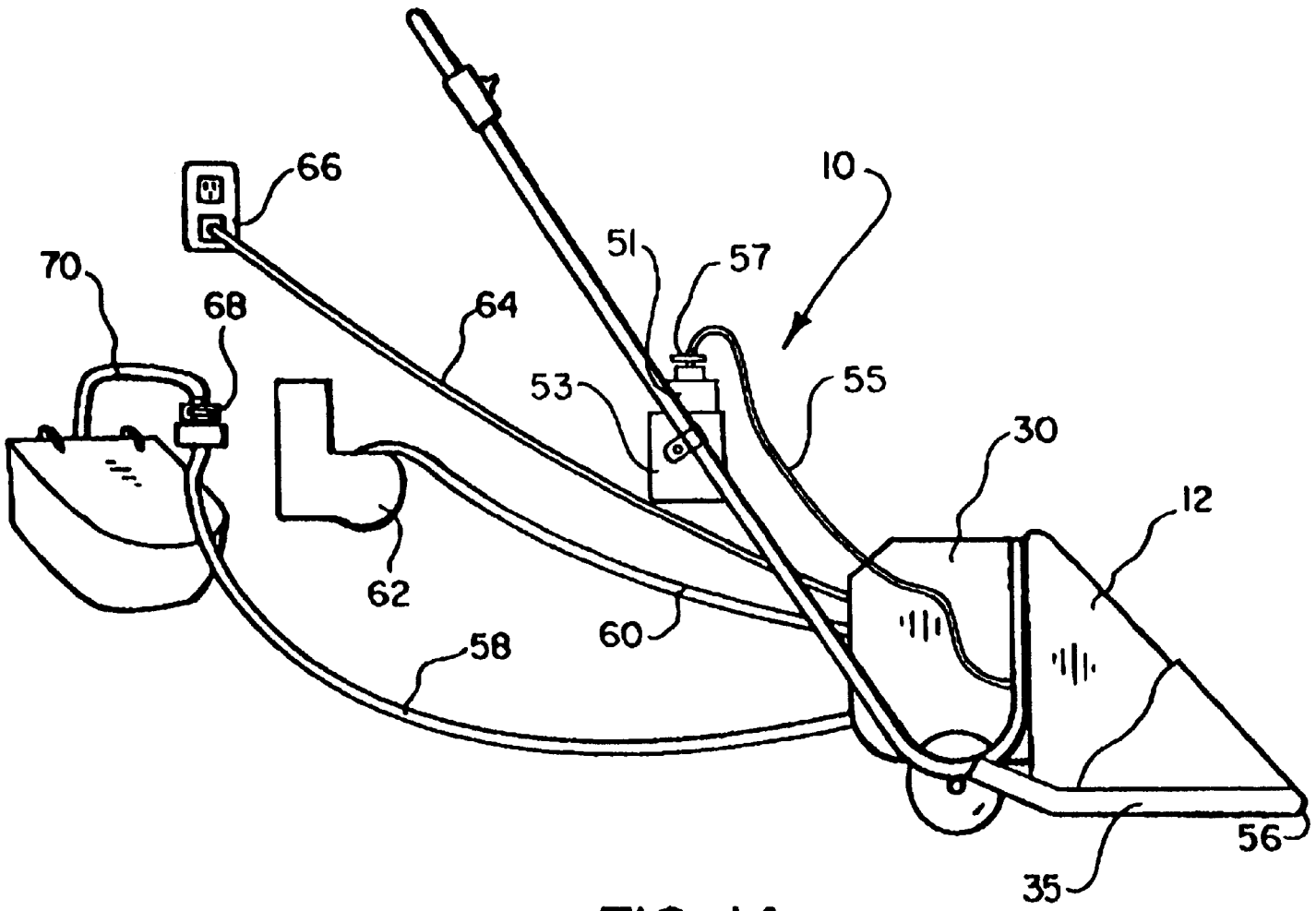
FIG. 14 details an alternative embodiment of the present invention utilizing an automatic defoaming dispenser.

Further shown in FIG. 2 is the front lip member 35 which is u-shaped and receives the bottom edge of the outer face 37. Front lip member 35 further strengthens the leading edge of the tank 12 and overwraps the wing braces 29 and extends rearwardly to attach to handle 11 which is shown in FIG. 14. The front lip member 35 and the construction of the front end of outer face 37 is shown more clearly in FIG. 2*a*. As can be seen in this Figure and in conjunction with FIG. 10, inner and outer lip members 54 and 52 of FIG. 10 are in fact front lip member 35 and rear lip member 35*a* shown in FIG. 2*a*. They have been separated here for ease of understanding. In FIG. 2*a,* outer face 37 ends and must be covered in order to provide a smooth surface. Front lip member 35 is provided with a U-shaped channel on its front edge for receiving the leading edge of face 37. Front lip member 35 thus receives the front edge of face 37 and retains it within this channel and provides a smooth bottom surface for contact to the carpet surface. Front lip member, while having this u-shaped channel for receiving the lower edge of face 37, also extends rearwardly to attach to handle 11. Further, inner face 39 additionally ends in a rough edge and similarly must be covered with a smooth bottom surface. Rear lip member 35*a* is therefor provided behind front lip member 35 with a similar unshaped channel for receiving the bottom edge of face 39. The ends of rear lip member 35*a* then are directly affixed to the rearwardly projecting side elements of the front lip member 35 thereby leaving a small gap between front lip member 35 and rear lip member 35*a* which forms the vacuum channel 56. The front lip member 35 and rear lip member 35*a* correlate with the inner and outer lips 54 and 52 shown in FIG. 10.

Once the recovery tank 12 is formed and welded, five structures are mounted together to form the machine 10. Shown in FIG. 4, the recovery tank 12 contains the vacuum motor 24 designated with a circled V, the discharge pump 26 designated with a circled P, and the solenoid valve 28 designated with a circled S. Connected therewith are the engine compartment housing 30 in FIG. 5 and the handle assembly 45 of FIG. 3 which is shown connected to the recovery tank in FIG. 5.

The vacuum motor 24 mounts over a hole 72 in the back of the recovery tank 12. This hole is called the vacuum hole 72 and is shown in phantom in FIG. 2. The vacuum hole 72 creates a vacuum in the center of recovery tank 12 once the vacuum motor is switched on.

Figure 6:
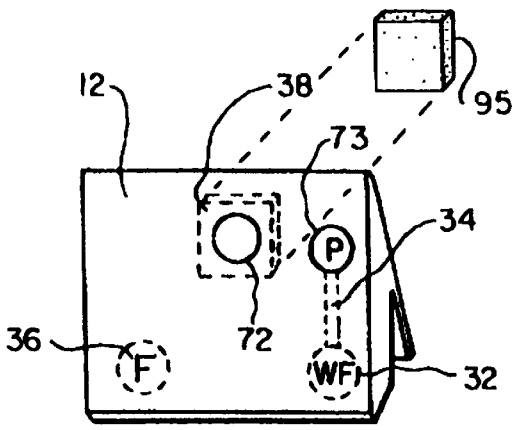
FIG. 6 shows a perspective view of the back of the recovery tank showing the parts contained within the recovery tank of FIG. 5.

The discharge pump 26 mounts over aperture 73 in the back wall of the recovery tank 12 as shown in FIG. 6. The discharge pump 26 is attached to the recovery tank 12 discharge hose 34 shown in FIG. 6 which connects the pump 26 to the water filter 32 also located in the interior of the recovery tank 12.

The solenoid valve 28 also mounts to the back of the recovery tank 12 in the interior of the housing 30. This solenoid valve controls water flow to the spray jet 44 shown in FIGS. 7 and 8 and is opened and closed by switch 18. Spray jet 44 is connected via hose 46 to the solenoid valve 28 to allow water from the water supply source 70 through spray jet 44 and onto the carpet. As mentioned, this valve 44 is of such a dimension to dispense a large volume of water, an amount greater than 1.5 gallons per minute.

Figure 5:
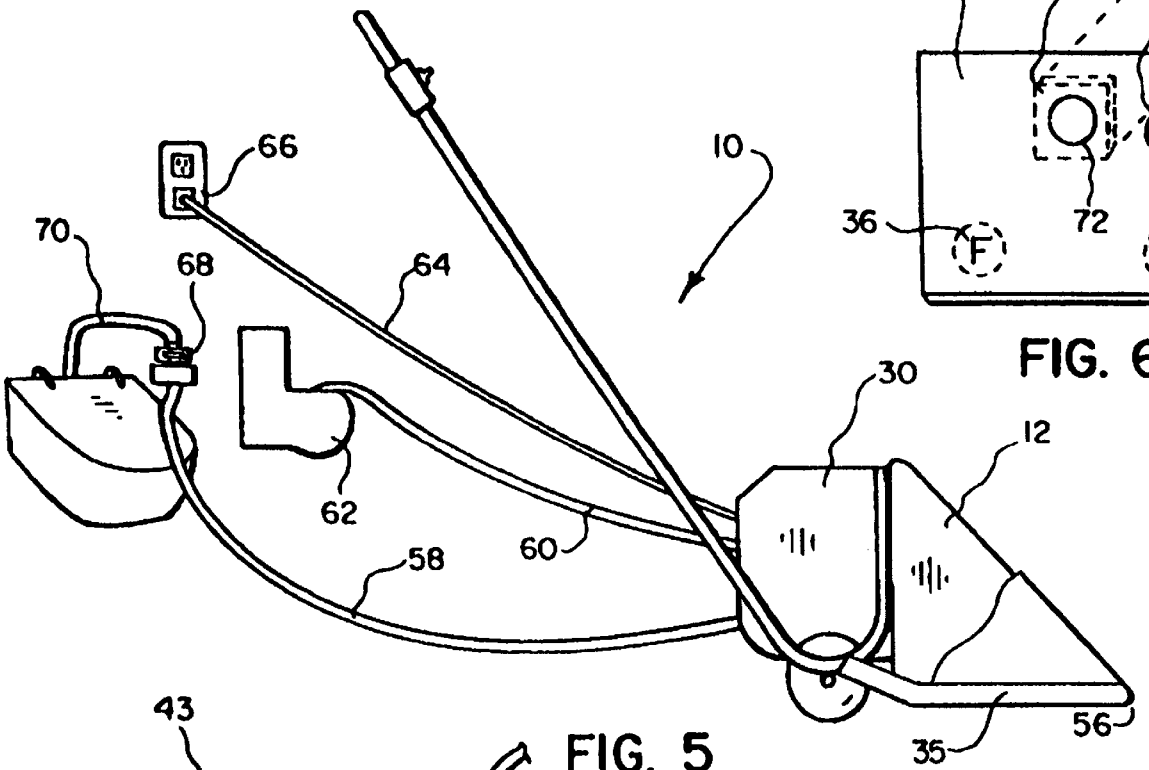
FIG. 5 shows a side view of carpet cleaning machine of the present invention with hoses attached.

The present high flow system 10 shown in FIG. 5 utilizes the high flow water provided by the faucet to pass through the pressure hose 58, through the solenoid valve 28, through the large spray nozzle 44 an onto the carpet. This high flow concept dispenses large amounts of water through the nozzle 44, preferentially on the order of between 3 to 4 gallons per minute. Such high flow rates increases the cleaning efficiency of the machine 10 and works in conjunction with a vacuum source of sufficient strength and design so as to remove the water from the carpet at similar high volumes. The engine compartment housing 30 shown in FIG. 5 also mounts on the back of the recovery tank 12. This housing 30 is made out of ⅛ inch thick vacuum formed plastic. Its main function is to cover and protect the vacuum 24, pump 26 and valve 28 from dust, lint, water and other material.

The handle assembly 45 of FIG. 3 also attaches on the back of the recovery tank 12 as shown in FIG. 5. On the inside of the recovery tank 12 are three essential parts. The float switch 36 shown in FIG. 6 is mounted in the interior of tank 12 and is designated with a circled F. The water filter 32 is designated with a circled WF, and the baffle 38 are also shown. The float switch 36 regulates the amount of extracted water contained in the recovery tank 12 by actuating the pump. When the water level reaches three inches on the inside of the recovery tank 12, the float switch activates the discharge pump 26. The discharge pump starts pumping the water out of the recovery tank 12 until the water level on the inside of the recovery tank 12 goes down to 2 inch level. When the water level reaches about ½ inch in tank 12, the float switch 36 deactivates the discharge pump.

The water filter 32 filters the extracted water in the recovery tank 12 from hair, lint, sand and other material. The filter is required to protect the discharge pump 26. The filter 32 is made from 26 gauge perforated stainless steel with 0.032 diameter holes. The filter 32 may also be made from filtering cloth bags or other similar material for ease of replacement.

The baffle 38 mounts over the vacuum aperture 72 on the interior of the recovery tank 12 and is made from ⅛ inch thick vacuum formed plastic. The opening on the baffle 38 that allows vacuum to enter the recovery tank 12 is located as high up on the baffle as possible. This opening is used to channel the vacuum generated by the vacuum motor 24 to the top of the recovery tank 12. The location of the baffle 38 and aperture 72 creates the height differential between the vacuum entrance point and the highest extracted water level. This height differential prevents the vacuum motor from drawing in the extracted water on the bottom of the recovery tank 12 thereby ruining the vacuum motor.

An air filter 95 shown in FIG. 6 goes over the baffle. This filter can be made out of foam, perforated metal, or the like material. It is mainly of import when the machine is being used for dry vacuuming. This air filter prevents line, hair and other unwanted material from being drawn into the vacuum motor.

Figure 7:
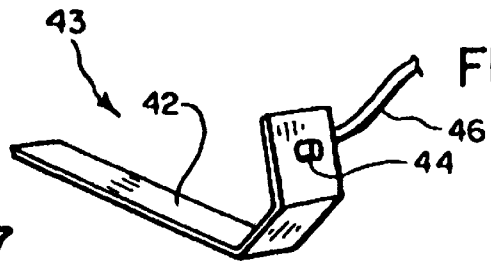
FIG. 7 shows the spray jet assembly attached to the machine of FIG. 5.
Figure 8:
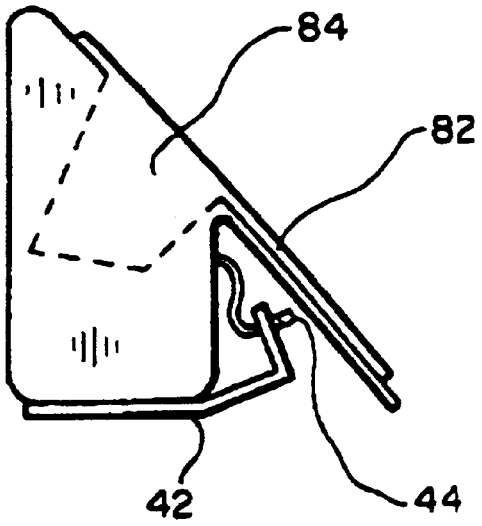
FIG. 8 shows a side view of recovery tank of FIG. 6 with a window channel assembly, water channel and spray jet assembly attached.

The spray jet assembly 43 of FIG. 7 contains the spray jet support 42, the spray jet 44, and the spray jet supply hose 46. This assembly 43 mounts on the bottom of the recovery tank 12 as shown in FIG. 8. The spray jet support 42 is used to secure the spray jet 44 in a fixed position on the bottom of the tank 12. The spray jet supply hose 46 attaches to the front of the solenoid valve 28 and provides water flow when the solenoid valve 28 is open. Spray jet 44 directly impacts the amount of water sprayed on the carpet and therefor a jet with sufficient orifice size must be used in conjunction with the water flow rate of the particular water source. If the water source does not provide sufficient water pressure or flow rate, a flow pump may be disposed between the water source and the valve 28 to increase the flow rate to desired levels.

Figure 13:
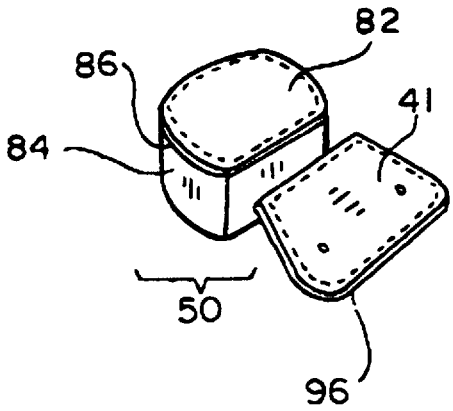
FIG. 13 shows the window channel assembly of the present invention.

On the front face of the recovery tank 12 is the large opening 48*a* and 41*a*. These openings are called the window channel opening 48*a* and water channel opening 41*a*. The window channel opening 48*a* is where the window channel assembly 50 shown in FIG. 13 is placed. The window channel assembly 50 is made of three main parts, the window 82, the channel 84, and gasket 86. The window 82 is made out of clear plastic and provides a visual effect when extracting. The operator is able to see the material being removed from the carpet.

The channel 84 is made out of vacuum formed plastic and attaches to the window 82. The channel 84 directs the extracted water entering the recovery tank 12 towards the bottom of the recovery tank 12. Without this channel the extracted water would easily be drawn through the baffle 38 and into the vacuum motor 24. The water channel piece 41 is located directly below the window 82 and fits within aperture 41*a*. Channel piece 41 is bolted to the tank as is shown in FIG. 12 and rests against outer face 37. Around the water channel is an additional gasket 96 to further prevent leakage. On either side of the channel piece 41 is located channel supports 27*a* and 27*b* which are shown in FIG. 2 in phantom. Channel supports 27*a* and 27*b* fit in between inner and outer faces 37 and 39 to direct and concentrate the vacuum towards the central area 47 just below window 82. Channel supports 27*a* and 27*b* are plastic formed members which are securely retained within water pick-up channel 56.

The gaskets 86 and 96 go around the outside of the window 82 and water channel piece 41. When the vacuum motor 24 is turned on, the vacuum generated by it pulls the window channel assembly 50 against the front face of the recovery tank 12 providing a vacuum seal.

Extending outward at the front of the recovery tank 12 are inner lip 52 and outer lip 54 shown in FIG. 10 and placed on inner and outer faces 39 and 37. Both the inner and outer lips are made of 18 gauge stainless steel and provide a tough long lasting surface for the water pick-up channel 56 of the machine 10. The inner lip 52 and outer lip 54 are attached with about a ⅛ inch gap between them and give farther support to the downward extending edges of the faces 39 and 37. The ⅛ inch gap forms a water pickup channel 56 to the inside of the recovery tank 12. This water pick-up channel 56 allows vacuum generated by the vacuum motor 24 to contact the carpet. The vacuum draws water out of the carpet, between the lips 52 and 54, up the channel 56 and into the recovery tank 12. As noted in FIG. 2*a,* outer tank surface 37 of the tank 12 in addition to having outer lip 54 is surrounded by front lip member 35 which wraps entirely around the front edge of the tank and water pick-up channel and attach at rear points to the machine handle. This structure is not completely shown in FIG. 2*a* for clarity. The entirety of the elements surrounding the water pick-up channel provides significant support of the pick-up channel to prevent bending or other wear during use and maintains the appropriate distance between surfaces forming the channel in order to maintain a high vacuum at the carpet.

Two things are required to allow the machine 10 to perform at high efficiency. A constant high volume clear water source and the ability to discharge a high volume of extracted water. These two things are achieved with two hoses shown in FIG. 5, the supply hose 58 and the discharge hose 60. The supply hose 58 provides a source of clear water to the machine. On one end it connects to a clean water source from a sink or faucet 70 and on the other end connects behind the solenoid valve 28.

The discharge hose 60 provides a way for the machine 10 to dispose of extracted water. It connects on one end to the back of the discharge pump and on the other end into a toilet 62 or other drain.

Another item the machine 10 needs to operate is an electric source for powering the vacuum, pump and other electrical devices. Since the machine 10 runs on a regular AC current, this is achieved with a power cord 64 which power is then easily dispersed to the various motors within cover 30.

To make the high flow machine practical it needs both a constant high volume water source and the ability to discharge the dirty extracted water. By using a faucet adapter 68, the machine 10 supply hose 58 is connected directly to the faucet 70 or other hot water source. This gives the machine 10 access to a high flow pressurized water system. Once connected to the water system the hot water is turned on. The normally closed valve 28 blocks any water flow until switch 16 is activated. The end of the discharge hose 60 is placed in a drain or into a toilet 62 for disposal of collected water in tank 12 which is flushed into hose 60.

To use the high flow cleaner 10, spray jet switch 18 is closed which opens the solenoid valve 28 allowing water from the faucet to pass through to the spray jet 44 which sprays the water on the carpet. The machine is pulled backwards to extract the water into the tank 12. As the machine is pulled backwards, the water pick-up channel 56 vacuums the water out of the carpet and into tank 12 for disposal through hose 60. To stop the cleaning process, turn the spray jet switch off which closes the solenoid valve and water flow to the spray jet 44 stops.

As the machine 10 is operated, pulling the machine backwards with spray jet switch on, the water pick-up channel 56 draws the dirty extracted water into the recovery tank 12. Once inside the recovery tank 12 the dirty water is directed by the channel 84 to the bottom of the recovery tank 12. When the level of dirty water on the bottom of the recovery tank 12 reaches 3 inches, the float switch 36 activates the discharge pump 26. The discharge pump pulls the dirty water in the recovery tank 12 through the water filter 32 and up the recovery tank 12 discharge hose 34 through the discharge pump and into the toilet 62 or other sanitary disposal. When the discharge pump has removed all but about 2 inches of extracted water from the bottom of the recovery tank 12, it is deactivated by the float switch 36. When the extracted water level reaches 3 inches, the float switch 36 will reactivate the discharge pump 26.

If it is desired to use a recovery tank having a larger volume than 1 cubic foot, possibly on the order of up to 5 cubic feet, a larger vacuum source must be utilized in order to maintain the vacuum response of the system. Thus, equivalent water lift must be provided while moving five times the volume of air. This high flow system may also be combined with a system not using a discharge pump and having a closed circuit water supply and recovery system, such as a mobile carpet cleaning system utilizing a wand for injection and recovery of water connected directly to a water source. Such design is achievable as long as an adequate vacuum source is maintained and the flow rate and vacuum source are adequately matched as to remove sufficient quantities of water preventing the over-wetting problems noted above.

Most carpets have detergent residues from prior cleanings or other sources. A problem with having detergent residues is that when their flushed out and enter into a relatively small recovery tank, excess foam in the tank can develop and which may be drawn into the vacuum source. To resolve this problem, an automatic defoamer may be utilized as is shown in FIG. 14. A quart bottle 51 containing a defoaming agent is placed within chemical tray 53. Extending outward of the bottle 51 is solution line 55 which enters into recovery tank 12 through housing wall 30. A clamp 57 or other regulator acts to limit the flow of the defoaming agent through line 55. The vacuum formed in tank 12 acts to pull the agent from the bottle 51 into the tank thereby preventing the foam in tank 12 to build up and enter into the vacuum source.

Even though the present machine 10 uses a much higher water flow, more than 3 times as much, than other known machines, it leaves carpets much dryer. Since water is the only carrier of dirt and soils in the steam carpet cleaning process, the machine 10 has greatly increased the cleaning process of steam To carpet cleaning by increasing the flow rate of said water.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What I claim is:

1. A high flow carpet cleaning machine, comprising:

a recovery tank having a water pickup channel extending downward therefrom and in flow communication therewith;

a vacuum source attached to said recovery tank and maintaining a partial vacuum in said recovery tank;

a discharge pump connected to the interior of said recovery tank;

a spray jet in flow communication with a water source wherein said spray jet is capable of discharging a volume of water onto a carpet, said volume being at least 1.5 gallons per minute and wherein said water pickup channel removes fluid from said carpet and into said recovery tank.

2. The carpet cleaning machine of claim 1 further comprising a valve inserted between said spray jet and said water source, said valve operably connected to a switch for opening and closing said valve.

3. The carpet cleaning machine of claim 1 wherein said discharge pump operably removes water from said recovery tank through a discharge hose.

4. A high flow carpet cleaning machine for cleaning carpets, comprising:

a recovery tank in flow communication with a water pick-up channel;

a vacuum source attached to said recovery tank maintaining a partial vacuum in said recovery tank;

a discharge pump connected to the interior of said recovery tank;

a solenoid valve connected to a water supply in flow communication with a spray jet wherein said solenoid valve is capable of discharging a volume of water through said spray jet onto said carpet at a rate of at least 1.5 gallons per minute, wherein said vacuum source removes water from said carpet through said water pick-up channel into said recovery tank and said discharge pump removes water from said recovery tank.

5. The carpet cleaning machine of claim 4 further comprising a handle assembly, said handle assembly supporting said recovery tank, said vacuum source and said discharge pump.

6. The carpet cleaning machine of claim 5 wherein said handle assembly has an axle extending there through and supporting said carpet cleaning machine.

7. The carpet cleaning machine of claim 4 wherein said recovery tank has a forward and downwardly extending water pick up channel.

8. The carpet cleaning machine of claim 7 wherein said water pick up channel has a width of about ⅛ inch.

9. The carpet cleaning machine of claim 8 wherein said water pick up channel has first and second channel supports on each side of said channel which directs the flow of water to the center of said recovery tank.

10. The carpet cleaning machine of claim 9 wherein said recovery tank further has a channel piece on the upper interior surface of said tank directly above and between said first and second channel supports, wherein said first and second channel supports direct the flow of water towards said channel piece which further directs said water to the bottom interior portion of said recovery tank.

11. The carpet cleaning machine of claim 7 wherein said water pick up channel has a first wing brace on a first side and a second wing brace on a second side, said first and second wing braces extending rearwardly to support said water pick up channel against the main body of said recovery tank.

12. The carpet cleaning machine of claim 7 wherein said recovery tank is less than 1 cubic foot in volume.

13. The carpet cleaning machine of claim 4 further comprising a float switch on the interior of said recovery tank, said float switch operably connected to said discharge pump.

14. The carpet cleaning machine of claim 4 wherein said water recovery tank is in flow communication with a container of defoaming agent, said defoaming agent is pulled from said container by said vacuum source in said recovery tank.

15. The carpet cleaning machine of claim 14 further comprising a regulator to regulate the flow of said defoaming agent to said recovery tank.

16. The carpet cleaning machine of claim 4 wherein said vacuum source is connected to the interior of said recovery tank at a point about 9.5 inches from the bottom of said tank.

17. The carpet cleaning machine of claim 4 wherein water flows through said jet at a rate of about three to four gallons per minute.

18. The carpet cleaning machine of claim 4 wherein said spray jet has an orifice of about 0.172 inch.

19. The carpet cleaning machine of claim 4 further comprising a baffle, said baffle connecting said vacuum source to the interior of said recovery tank and directing said vacuum source to the top most portion of said recovery tank.

20. The carpet cleaning machine of claim 4 further comprising a window channel on the top wall of said water pick-up channel, said channel redirecting water drawn into said water pick-up channel to the bottom of said recovery tank.

21. A high flow carpet cleaning machine for cleaning carpets comprising:

a recovery tank in flow communication with a water pick-up channel;

a vacuum source attached to said recovery tank maintaining a partial vacuum in said recovery tank;

a valve connected to a water supply and in flow communication with a spray jet wherein said spray jet is capable of discharging a volume of water onto a carpet, said volume being at least 1.5 gallons per minute, wherein said carpet cleaning machine has a flow rate of at least one and a half gallons per minute.

22. The carpet cleaning machine of claim 21 wherein said recovery tank has forwardly and downwardly projecting inner and outer lips, said water pick up channel disposed therebetween, said water pick up channel in fluid connection with the interior of said recovery tank and having first and second channel supports directing the flow of water inward towards a water channel, said water channel further detecting the flow of water to the bottom of said recovery tank.

* * * * *

UNITED STATES PATENT AND TRADEMARK OFFICE

CERTIFICATE OF CORRECTION

PATENT NO. : 6,125,499
DATED : October 3, 2000
INVENTOR(S) : Downey

It is certified that error appears in the above-identified patent and that said Letters Patent is hereby corrected as shown below:

Column 10,
Lines 64 and 65, change "detect-ing" to -- direct-ing --.

Signed and Sealed this

Twenty-third Day of April, 2002

*Attest:*

*Attesting Officer*

JAMES E. ROGAN
*Director of the United States Patent and Trademark Office*